US006717549B2

(12) United States Patent
Rawnick et al.

(10) Patent No.: US 6,717,549 B2
(45) Date of Patent: Apr. 6, 2004

(54) DUAL-POLARIZED, STUB-TUNED PROXIMITY-FED STACKED PATCH ANTENNA

(75) Inventors: James J. Rawnick, Palm Bay, FL (US); Timothy E. Durham, Palm Bay, FL (US); Anthony M. Jones, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/146,227

(22) Filed: May 15, 2002

(65) Prior Publication Data

US 2003/0214437 A1 Nov. 20, 2003

(51) Int. Cl.[7] ..... H01Q 1/38

(52) U.S. Cl. ..... 343/700 MS; 343/745; 343/749; 343/815

(58) Field of Search ..... 343/700 MS, 745, 343/749, 815, 818, 829, 831, 846, 848

(56) References Cited

U.S. PATENT DOCUMENTS 4,835,538 A * 5/1989 McKenna et al. ... 343/700 MS
5,005,019 A * 4/1991 Zaghloul et al. ..... 343/700 MS
5,453,751 A * 9/1995 Tsukamoto et al. .. 343/700 MS
5,661,494 A * 8/1997 Bondyopadhyay ... 343/700 MS
5,874,919 A 2/1999 Rawnick et al. ..... 343/700
5,894,983 A 4/1999 Beck et al. ..... 228/110.1
5,907,304 A 5/1999 Wilson et al. ..... 343/700
5,995,047 A * 11/1999 Freyssinier et al. .. 343/700 MS
6,069,587 A 5/2000 Lynch et al. ..... 343/700
6,104,348 A * 8/2000 Karlsson et al. ..... 343/700 MS
6,118,406 A 9/2000 Josypenko ..... 343/700
6,320,509 B1 11/2001 Brady et al. ..... 340/572.7
6,492,947 B2 * 12/2002 Anderson ..... 343/700 MS

* cited by examiner

*Primary Examiner*—Tan Ho
(74) *Attorney, Agent, or Firm*—Allen, Dyer, Doppelt, Milbrath & Gilchrist, P.A.

(57) ABSTRACT

A dual-polarized, stub-tuned, proximity-fed, stacked patch antenna includes a ground plane layer and a dielectric substrate overlying the ground plane layer. An active patch antenna element is disposed on the dielectric substrate. A parasitic patch antenna element is supported in spaced relation to the active patch antenna element. Dual feed lines are spaced from and field-coupled to the active patch antenna element. Each feed line has a tuning stub for producing a distributed antenna resonance. The dual feed lines are configured to provide dual polarization and minimize coupling between the feed lines. The feed lines are positioned substantially orthogonal to each other to provide orthogonal linear polarizations. Each feed line includes a feed line tip that extends towards the center of the active patch antenna element and spaced from each other to minimize tip-to-tip coupling. Each feed line tip includes a 90 degree bend.

26 Claims, 5 Drawing Sheets

DUAL-POLARIZED, STUB-TUNED PROXIMITY-FED STACKED PATCH ANTENNA

FIELD OF THE INVENTION

The present invention relates to the field of communication systems and, more particularly, to a patch antenna used in spaceborne and phased array antenna systems.

BACKGROUND OF THE INVENTION

A single linearly-polarized, proximity-fed stacked patch antenna is disclosed in commonly assigned U.S. Pat. No. 5,874,919 to Rawnick et al., the disclosure which is hereby incorporated by reference in its entirety. This stacked patch antenna advantageously provides an active and parasitic patch antenna element having a distributed antenna resonance characteristic. A patch antenna element is secured by conventional pick-and-place techniques on a dielectric substrate having a feed line with a tuning stub. In this design, the antenna is a stub-tuned, proximity-fed, stacked patch antenna configuration having a primary "active" (disk-shaped) patch antenna element and a secondary "parasitic" or passive (disk-shaped) patch antenna element of a different size that resonates at respectively different or offset frequencies. The primary or active patch is field-coupled to, rather than pin-fed by, the conductive microstrip feed line formed as a layer on top of the dielectric substrate overlying a ground plane. The structure can define a front face sheet of a panel-configured antenna module.

The microstrip feed line includes an antenna tuning stub formed adjacent to the active patch antenna element that produces an additional resonant frequency in the vicinity of the resonant frequency of the active patch and that of the parasitic/passive patch. The close proximity of the tuning stub to the stacked patch antenna causes electromagnetic field energy associated with the tuning stub to be coupled with the active and parasitic patch antenna elements, causing the patch antenna to exhibit an additional radiating mode, creating a distributed resonance characteristic that is a composite of the three components. It has an augmented bandwidth compared with that of a conventional patch antenna using a pin feed.

Space-qualifiable, pressure-sensitive adhesive material is interleaved among the parasitic patch antenna element, an insulating spacer disk, and the active patch antenna element. The parasitic and active patch antenna elements and insulating spacer disk form a patch antenna element that can be pick-and-placed onto a dielectric substrate and a ground plane-defining front face sheet by methods known to those skilled in the art.

This design provides a single polarization. A need has arisen in the industry for a dual-polarization configuration. A drawback of the system is that the feed mechanism is not amenable to a dual-polarized element design via the standard manufacturing design practice as disclosed within the incorporated by reference '919 patent, where the feed line extends to the center of the patch. The length of this feed line is critical to antenna element performance. The structure as designed cannot be dual-polarized by adding overlapping feed lines at the center, which would create coupling between the feed lines, and thus, negate the entire function of the patch antenna.

SUMMARY OF THE INVENTION

In view of the foregoing background, it is therefore an object of the present invention to provide a stub-tuned, proximity-fed, stacked patch antenna that provides dual polarization.

This and other objects, features and advantages, in accordance with the present invention, are provided by a proximity-fed, stacked patch antenna that includes a ground plane layer and a dielectric substrate overlying the ground plane layer. An active patch antenna element is disposed on the dielectric substrate. A parasitic patch antenna element is supported in spaced relation to the active patch antenna element. Dual feed lines are spaced from and field-coupled to the active patch antenna element. Each feed line has a tuning stub for producing a distributed antenna resonance. The dual feed lines are configured to provide dual polarization and minimize coupling between the two feed lines.

In one aspect of the present invention, each feed line comprises a microstrip feed line formed on the dielectric substrate. In another aspect of the present invention, the feed lines are positioned substantially orthogonal to each other to provide orthogonal linear polarizations. Each feed line includes a feed line tip that extends towards the center of the active patch antenna element, but are spaced from each other to minimize tip-to-tip coupling. Each feed line tip includes a 90 degree bend forming a "chamfer" bend.

Each tuning stub also has a length of about one-half radius of the active patch antenna element. Each tuning stub can be located adjacent to the outer edge formed by the active patch antenna element. The active and parasitic patch antenna elements are formed of a metallic material, such as a foil disk for the parasitic patch antenna element.

In yet another aspect of the present invention, the active and parasitic patch antenna elements comprise circular disks and have a diameter greater than the diameter of the active patch antenna element. The active patch antenna element has a first resonant frequency and the parasitic antenna element has a second resonant frequency.

In yet another aspect of the present invention, the patch antenna element is formed from the active and parasitic patch antenna elements and adhesively secured onto the dielectric substrate, such as by pick-and-place techniques known to those skilled in the art.

A method of forming a proximity-fed, stacked patch antenna is also disclosed and comprises the step of positioning a patch antenna element formed of an active and parasitic patch antenna element over a dielectric substrate having a conductive feed layer of dual feed lines, such that the patch antenna element is field-coupled to the dual feed lines and configured to provide dual polarization and minimal coupling between the feed lines. The patch antenna element is adhesively adhered to the dielectric substrate.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

Figure 1:
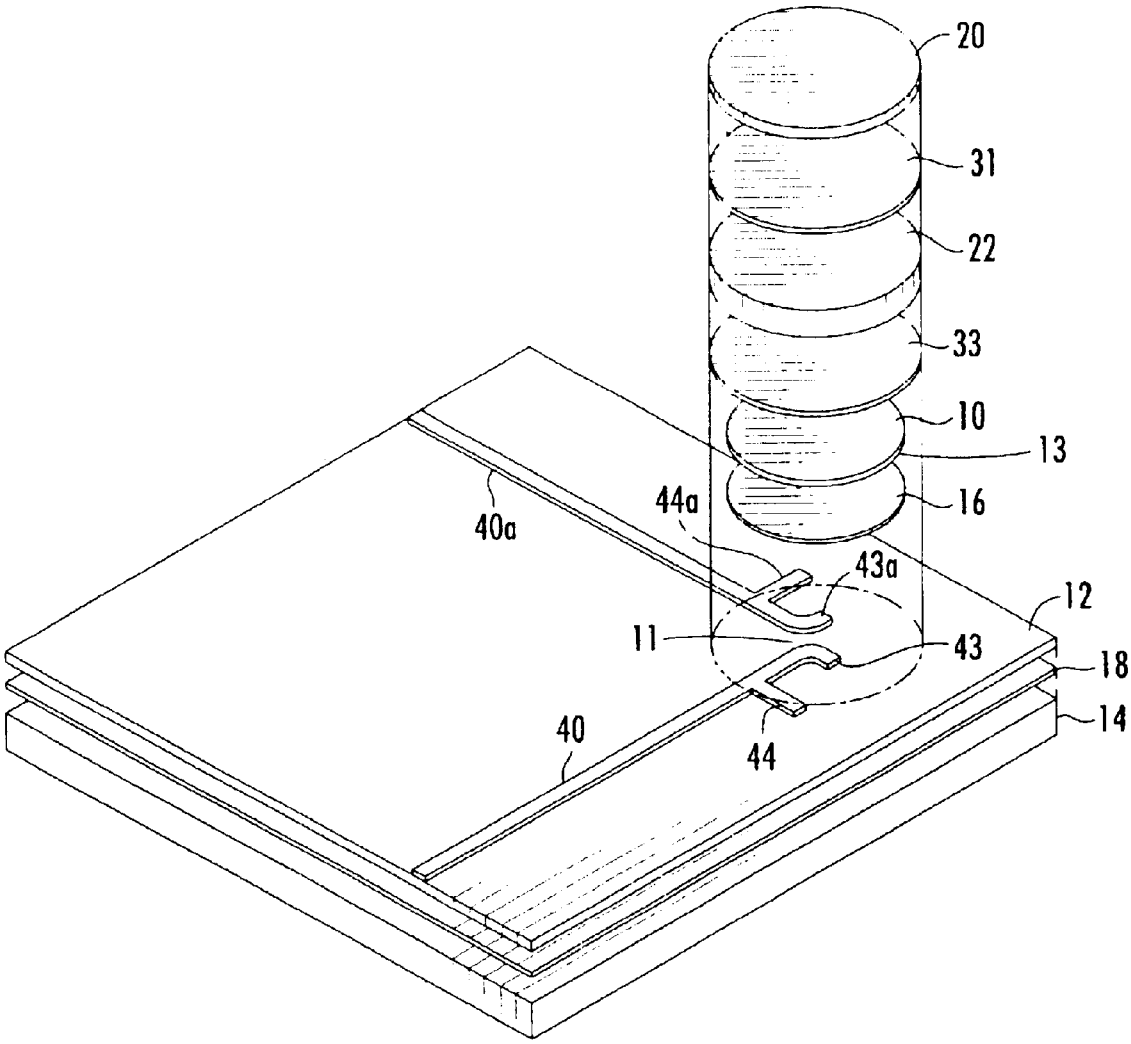
FIG. 1 is a diagrammatic perspective and exploded view of the proximity-fed, stacked patch antenna of the present invention.
Figure 2:
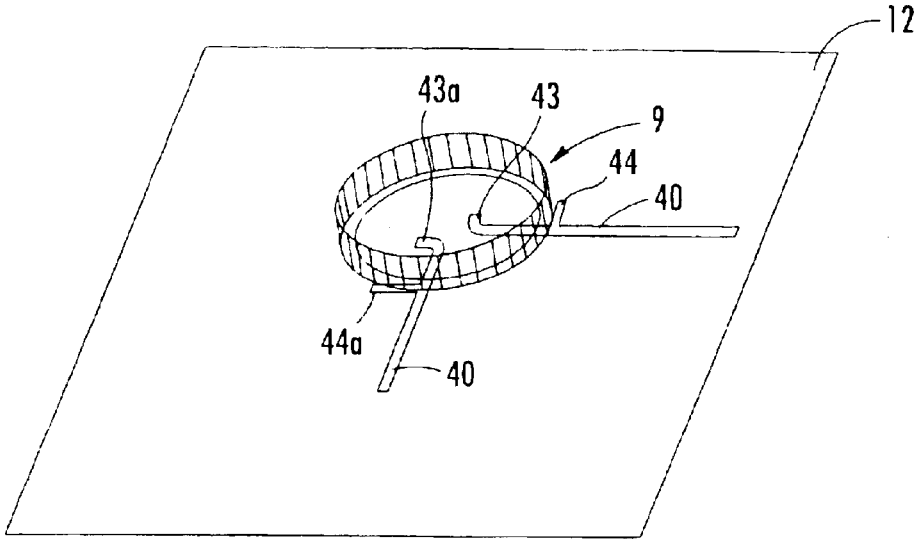
FIG. 2 is a fragmentary, isometric view of the patch antenna of the present invention and showing the configuration of the patch antenna element formed of active and parasitic patch antenna elements relative to the dual feed lines.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

The present invention provides a stub-tuned, proximity-fed, stacked patch antenna that overcomes the disadvantages of the single polarized prior art patch antenna, and provides dual polarization with minimal coupling between feed lines. The present invention adds a second feed line in a preferred orthogonal configuration, while maintaining a critical length of the feed line that is necessary for antenna performance across the bandwidth. A "chamfered" 90 degree bend is applied at the tips of the dual feed lines near the patch center. The total feed line length is, thus, maintained constant. The dual feed line configuration does not significantly affect the resonances of the active or parasitic patch antenna elements or the wide bandwidth. The antena configuration provides a high isolation of greater than 20 decibels between the feed lines because both sections of each feed line are configured in a preferred orthogonal manner. It is easily tuned and no additional manufacturing technology is necessary. Throughout the description, a second feed line forming the dual feed line will be given the same reference numerals as the first feed line, except with the letter "a" added to the reference numeral.

FIG. 1 illustrates a patch antenna formed of various components as described below and in accordance with the present invention.

As shown therein, a patch antenna element 9 comprises an 'active' patch antenna element 10, such as a disc-shaped conductive layer (e.g., a layer of copper having a thickness in a range on the order of 0.7–1.4 mils, and a radius that defines a first resonant frequency falling within the design bandwidth of the antenna). By active is meant that an antenna microstrip feed layer 40, 40*a*, such as layers of 50 ohm transmission line, is field coupled to the active patch antenna element 10, so that in the radiating mode, active patch antenna element 10 serves as the primary or active emission element.

The active patch antenna element 10 is disposed atop a dielectric substrate 12, such as a ten mil thickness of woven-glass Teflon, e.g., Ultralam, (Teflon and Ultralam are trademarks of Dupont Corp.). This thin dielectric substrate 12 overlies a ground plane layer 14, such as the front face sheet of the panel-configured antenna module described in commonly assigned U.S. Pat. No. 5,907,304 to Wilson et al., the disclosure which is hereby incorporated by reference in its entirety.

The Wilson et al. patent describes a lightweight antenna sub-panel architecture, which is particularly suited for airborne and space deployable applications. A generally flat front or outer face sheet has an array of antenna elements affixed thereto. This front face sheet is bonded to a first surface of a structurally rigid, thermally stable, lightweight intermediate structure, preferably formed as a honeycomb-configured metallic support member. A rear face sheet supports a plurality of printed wiring boards containing beam-forming and signal distribution networks. Additional printed wiring boards contain DC power and digital control links and are mounted to a second surface of the intermediate honeycomb-configured support member.

The intermediate honeycomb-configured support structure has a plurality of slots that retain RF signal processing, such as amplifier and phase/amplitude control circuit modules. This provides a high compact, integrated architecture, which is readily joined with other laminate sub-panels to provide an overall antenna spatial configuration that defines a prescribed antenna aperture. The thickness of the intermediate support member is defined in accordance with the length of the RF signal processing modules, such that import/output ports, the RF modules, and opposite ends are substantially planar with the conductor traces on the front and rear face sheets, whereby the RF modules provide the functionality of RF feed through coupling connections between the rear and front face sheets of the antenna sub-panel.

To facilitate manufacture of the structure of the present invention, the active patch antenna element 10 is preferably attached to the dielectric substrate 12 by means of space-qualifiable adhesive material 16, such as a 'peel and stick' two mil thick layer of Y-966 acrylic PSA adhesive, manufactured by 3M. This adhesive material accommodates a layer of microstrip feed as dual feed lines 40, 40*a* between the active patch antenna element 10 and the dielectric substrate, so that the patch element is effectively plane-conformal with the substrate 12. The completed patch antenna element 9 with other components is formed such that it can be applied onto the dielectric substrate by normal pick-and-place techniques known to those skilled in the art.

The adhesive material used for layer 16 is also used to bond the other components of the stacked or laminate patch structure of the present invention to facilitate assembly of both an individual stacked patch antenna and also assembly of an array of such patches to the front facesheet of a modular antenna panel. To this end, a further layer 18 of adhesive is used to bond the dielectric substrate 12 to the ground plane layer 14.

The stacked patch configuration is further defined by the 'parasitic' or passive patch antenna element 20, such as a disc-shaped layer of one ounce copper foil, having a radius that defines a second resonant frequency that falls within the bandwidth of the antenna. The parasitic patch antenna element 20 is concentric with and vertically spaced apart from active patch antenna element 10, and has a radius larger than that of the active patch antenna element 10. This gives the parasitic patch antenna element 20 a resonant frequency that is slightly lower than that of the active patch antenna element 10. By parasitic or passive is meant that in the radiation mode, rather than being field coupled to a feed trace, as is the active patch antenna element 10, parasitic patch antenna element 20 is instead parasitically stimulated by the field emitted by the active patch antenna element 10. To support the larger radius passive copper foil patch 20 apart from active patch antenna element 10, an insulating spacer layer 22 (such as a dielectric foam layer) is disposed between the active patch antenna element 10 and the passive conductive patch antenna element 20.

As described previously, to bond the various layers of the stacked patch structure into a compact integrated assembly and form the patch antenna element 9 that can be secured by pick-and-place techniques, additional layers of adhesive material are preferably interleaved between successive conductive and dielectric layers of the stacked patch. Thus, an additional layer of adhesive material 31 is interleaved between and bonds together the copper foil, parasitic patch antenna element 20 and the insulator spacer layer 22. Also, a further layer of adhesive material 33 is interleaved between and bonds together the foam insulator spacer layer 22 and the active patch antenna element 10. As noted above, the adhesive layer that bonds the active antenna patch antenna element to the dielectric substrate accommodates the microstrip feed lines 40, 40*a* between the active patch antenna element 10 and the dielectric substrate, so that the patch element 10 is effectively plane-conformal with the dielectric substrate.

As pointed out briefly above, rather than provide a pin feed to the primary or active patch antenna element 10, which would require an electrical/mechanical bond attachment, such as a solder joint, signal coupling to and from active patch antenna element 10 is effected by the proximity feed system, in particular, the field-coupled, conductive microstrip feed layers formed as dual feed lines 40, 40*a*, which are patterned in accordance with a prescribed signal distribution geometry, associated with a plurality of patches of a multi-radiating element subarray. These microstrip layers 40, 40*a* extend from a (ribbon-bonded) feed location of a front other face sheet of an antenna panel over the surface of the dielectric substrate 12 to distal ends 43, 43*a* of microstrip 40, 40*a*, which serves as a proximity feed to the active patch antenna element 10.

Figure 3:
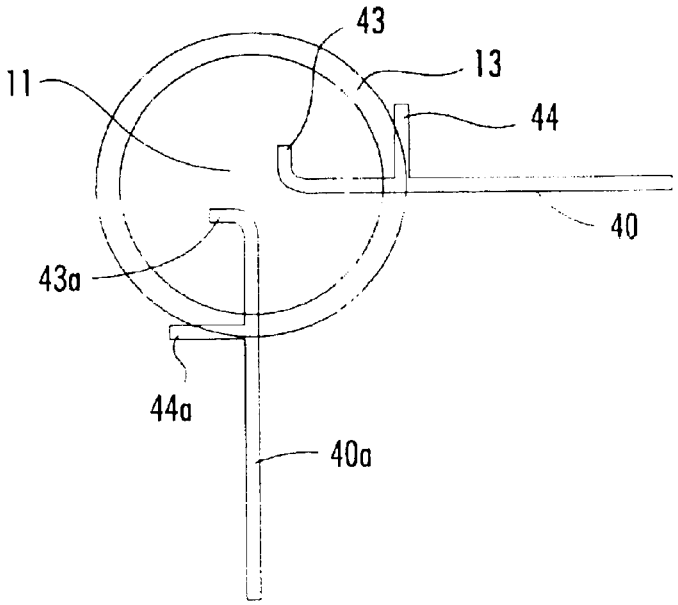
FIG. 3 is a diagrammatic, top plan view of the proximity-fed, stacked patch antenna of FIG. 1.

FIGS. 1 and 3 illustrate that the dual feed lines extend toward the center 11 of the active patch antenna element and each feed line includes a feed line tip 43*a* that extends toward the center of the element. The feed line tips are spaced from each other by providing a 90 degree bend (chamfer) to minimize any tip-to-tip coupling. The length of each dual feed line is the same and maintained such as in the prior art incorporated by reference '919 patent, where the feed line extends into the center to maintain the proper distributed antenna resonance. Each of the feed lines are positioned substantially orthogonal to each other to provide orthogonal linear polarizations.

Ribbon bonding of any microstrip feed location on the front face sheet of the antenna panel to an associated input/output port of an RF signal processing module described in the above-referenced Wilson et al. '304 patent is preferably effected by means of a low temperature, high frequency thermosonic bonding process, as described in commonly assigned U.S. Pat. No. 5,894,983, issued Apr. 20, 1999, by D. Beck et al. entitled: "High Frequency, Low Temperature Thermosonic Ribbon Bonding Process for System-Level Applications," the disclosure which is herein incorporated.

In accordance with the thermosonic ribbon bonding process described in the '983 patent, the respective bonding sites of any antenna panels can be maintained at a relatively low temperature, preferably in a range of from 25° C. to 85° C., to avoid altering the design parameters of system circuit components, especially the characteristics of the circuits within RF signal processing modules that are retained within an intermediate support structure of the antenna. To achieve the requisite atomic diffusion bonding energy, without causing fracturing or destruction of the ribbon or its interface with the low temperature bond sites, the vibrational frequency of an ultrasonic bonding head is increased to an elevated ultrasonic bonding frequency above 120 KHz and preferably in a range of from 122 KHz to 140 KHz. This combination of low bonding site temperature, high ultrasonic frequency and ribbon configured interconnect material makes it possible not only to perform thermosonic bonding between metallic sites that are effectively located in the same (X–Y) plane, but between bonding sites that are located in somewhat different planes, namely having a measurable orthogonal (Z) component therebetween.

Figure 4:
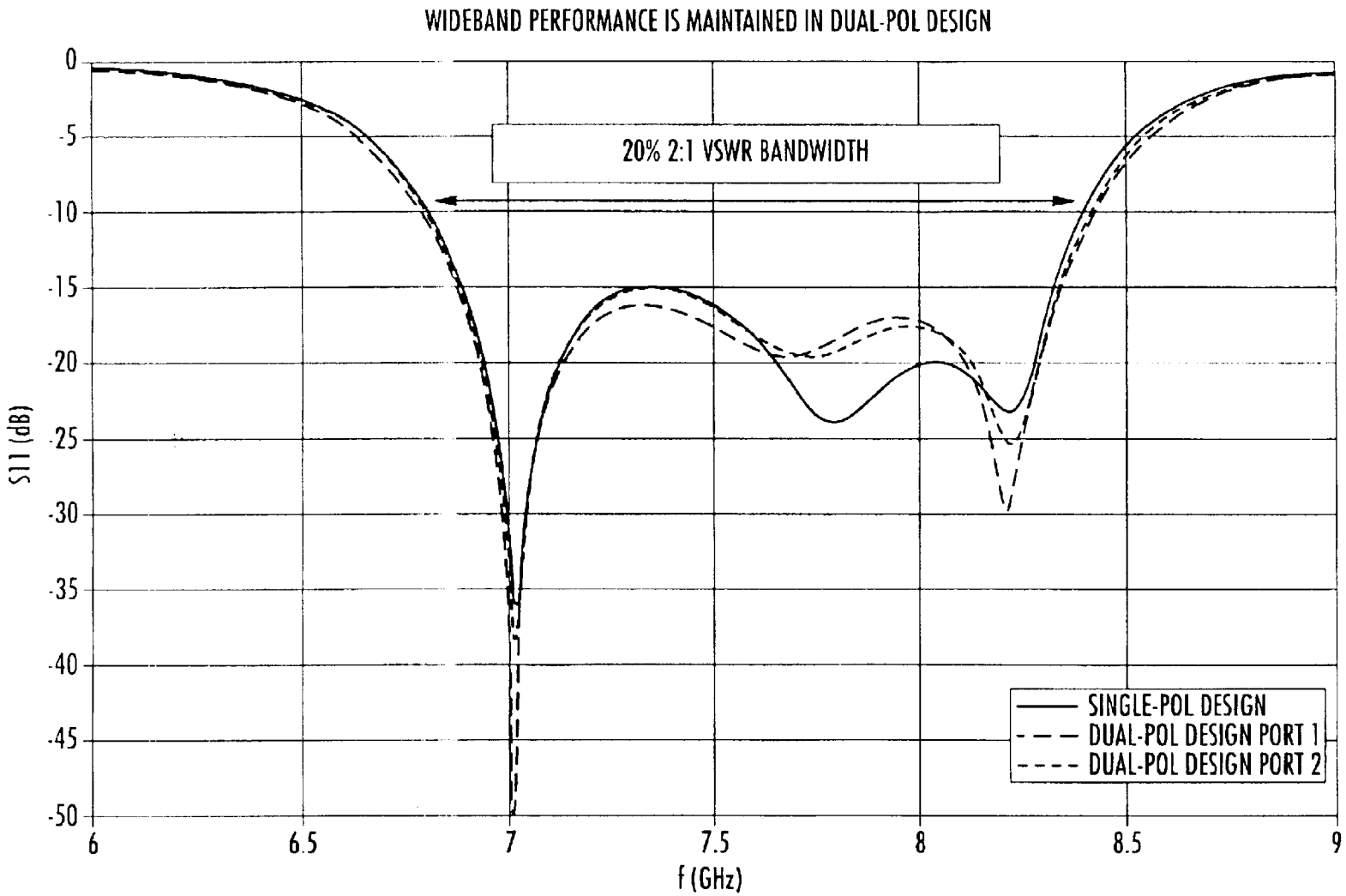
FIG. 4 is a graph showing a comparison of the single-polarization of the prior art and dual-polarization of the present invention, and showing wideband performance maintained in the dual-polarization design.
Figure 5:
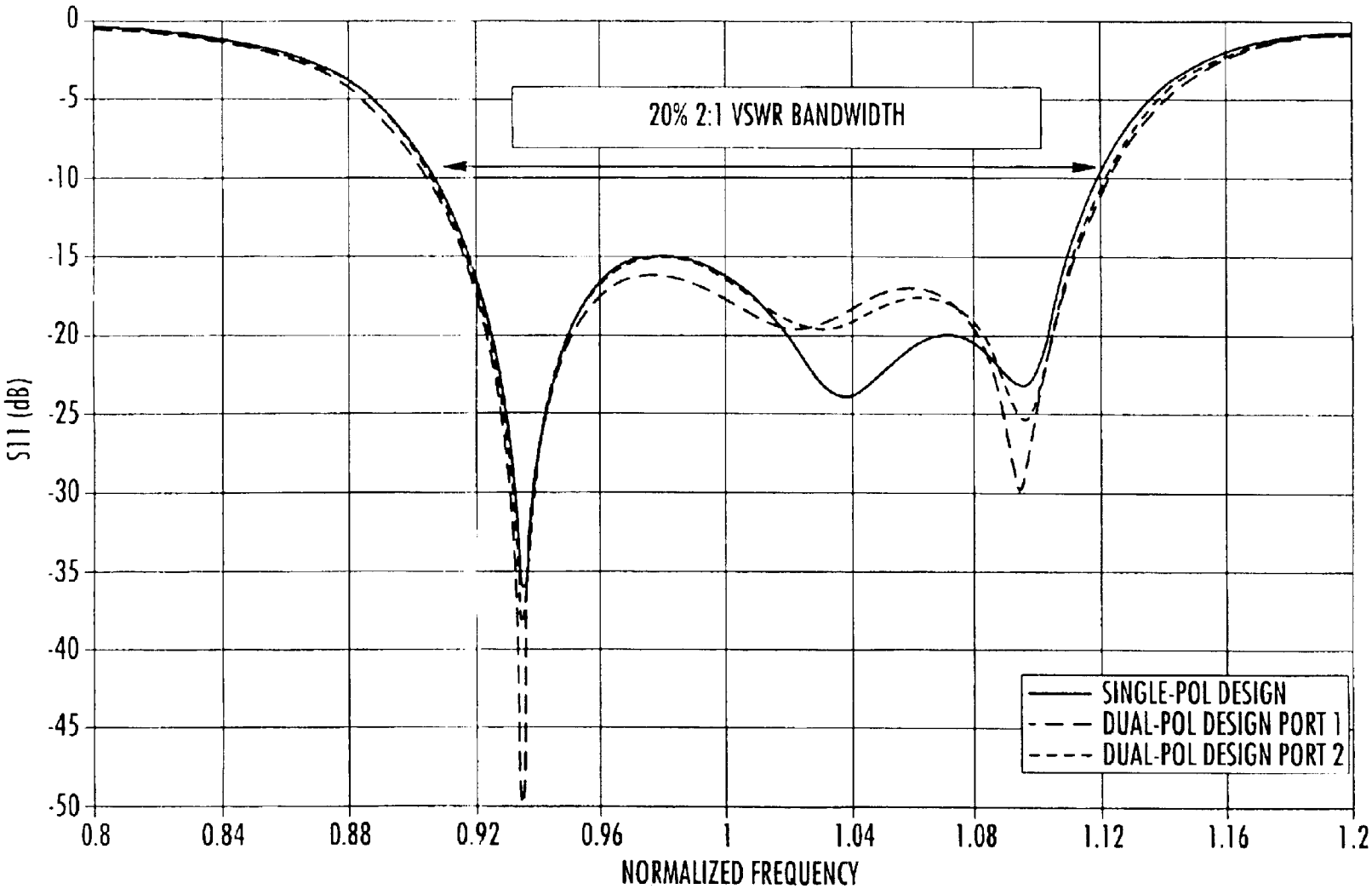
FIG. 5 is a graph similar to FIG. 4, but showing normalized frequency.

The microstrip feed layers 40, 40*a* each include an antenna tuning stub portion 44, 44*a* extending generally orthogonal to and located in close proximity of the outer edge 13 of the active patch antenna element 10. The length and location of the tuning stubs 44, 44*a* of microstrip feed layers 40, 40*a* are empirically defined to establish an additional resonant frequency between the resonant frequency of the active patch antenna element 10 and the resonant frequency of the parasitic patch antenna element 20, as illustrated in the normalized gain and S parameter (S11) vs. normalized frequency characteristic diagram of FIG. 5. A similar graph shown in FIG. 4 illustrates the frequency in GHz and shows the resonance at about 7.0 and 8.5 GHz. As a non-limiting example, tuning stubs 44, 44*a* may have a length on the order of one-half the radius of the active patch antenna element 10 and may be located immediately adjacent to the outer edge 13 of active patch antenna element 10.

The exact location of tuning stubs 44, 44*a* will depend upon the degree of resonant interaction and thereby the composite gain-bandwidth characteristic desired among the components of the stacked patch antenna structure. As described above, locating the tuning stubs 44, 44*a* in close proximity (e.g., within one-tenth of a wavelength of the edge 13 of the active patch) has been found to cause electromagnetic field energy associated with the tuning stubs 44, 44*a* to be coupled with the active and parasitic patch structure 10-20, causing the dual patch antenna structure to exhibit an additional radiating mode, thereby creating a distributed resonance effect that produces a composite gain-bandwidth characteristic having a wider frequency range than that of a conventional patch antenna (on the order of 15–20%, compared with the 10% figure of the prior art patch antenna, referenced above).

Figure 6:
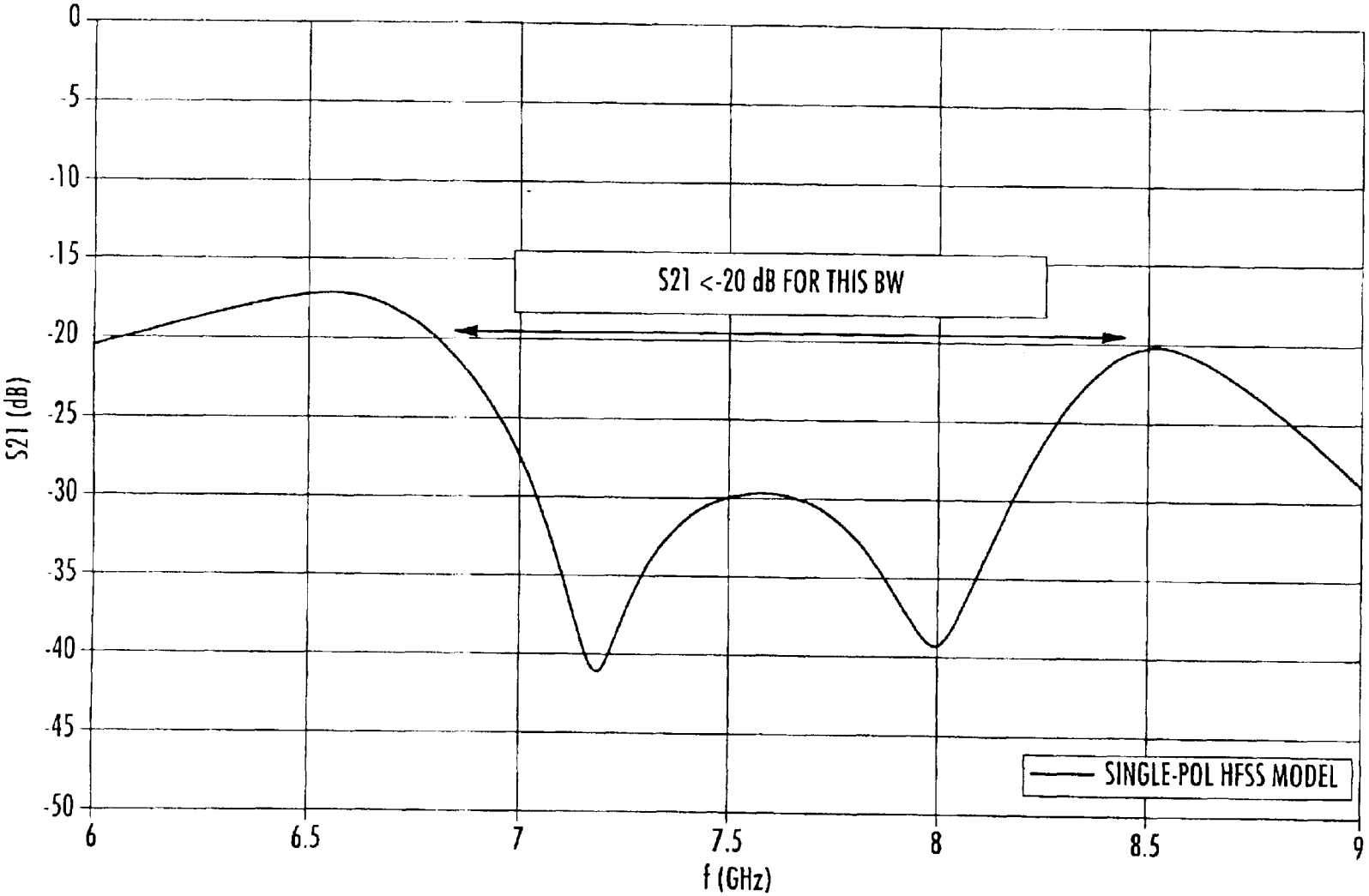
FIG. 6 is a graph showing the coupling between polarizations for the dual polarization antenna element with low coupling levels that translate into cross-polarization isolation.

FIG. 6 illustrates the coupling between polarizations for dual polarization element where the low coupling levels translate into sufficient cross-polarization isolation. S21 is seen less than 20 decibels for this bandwidth as illustrated between about 6.5 through about almost 8.5 GHz.

It is evident that the present invention is advantageous over a prior art, single polarization, proximity-fed, stacked patch antenna and now allows the proximity-fed element to be made dual-polarized by using dual feed lines that are spaced from and field-coupled to the active patch antenna element with each having a tuning stub for producing a distributed antenna resonance. The dual feed lines are configured to provide dual polarization and minimize coupling between the feed lines. A chamfered 90 degree bend at the tips is provided as the feed lines approach the center of the patches. As long as the total length of the feed line is not changed from a single polarization design, applying the bend does not significantly affect element performance. This allows the patch antenna element to be used for applications requiring a combination of linear polarizations, in accordance with the present invention.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A proximity-fed, stacked patch antenna comprising:

a ground plane layer;

a dielectric substrate overlying the ground plane layer;

an active patch antenna element disposed on the dielectric substrate and having an outer edge;

a parasitic patch antenna element supported in spaced relation to the active patch antenna element; and dual feed lines separate from each other and spaced from and field-coupled to the active patch antenna element and extending toward the center of the active patch antenna element, each feed line having a tuning stub generally orthogonal to each other and each located in close proximity to the outer edge of the active patch antenna element to establish an additional resonant frequency between a resonant frequency of the active patch antenna element and resonant frequency of the parasitic patch antenna element, wherein the dual feed lines are configured to provide dual polarization and minimize coupling between the feed lines.

2. A proximity-fed, stacked patch antenna according to claim 1, wherein each feed line comprises a microstrip feed line formed on the dielectric substrate.

3. A proximity-fed, stacked patch antenna according to claim 1, wherein said feed lines are positioned substantially orthogonal to each other to provide orthogonal linear polarizations.

4. A proximity-fed, stacked patch antenna according to claim 1, wherein each feed line includes a feed line tip that extends toward the center of the active patch antenna element, wherein said feed line tips are spaced from each other to minimize tip-to-tip coupling.

5. A proximity-fed, stacked patch antenna according to claim 4, wherein each feed line tip includes a ninety degree bend.

6. A proximity-fed, stacked patch antenna according to claim 1, wherein each tuning stub has a length of about one-half a radius of the active patch antenna element.

7. A proximity-fed, stacked patch antenna according to claim 1, wherein each tuning stub is located adjacent to an outer edge formed by the active patch antenna element.

8. A proximity-fed, stacked patch antenna according to claim 1, wherein said active and parasitic patch antenna elements are formed of a metallic material.

9. A proximity-fed, stacked patch antenna according to claim 8, wherein said parasitic patch antenna element comprises a foil disc.

10. A proximity-fed, stacked patch antenna according to claim 1, wherein said active and parasitic patch antenna elements comprise circular discs, said parasitic patch antenna element having a diameter greater than the diameter of said active patch antenna element.

11. A proximity-fed, stacked patch antenna according to claim 1, wherein said active patch antenna element has a first resonant frequency and said parasitic antenna element has a second resonant frequency.

12. A proximity-fed, stacked patch antenna comprising:

a ground plane layer;

a dielectric substrate overlying the ground plane layer;

a conductive feed layer formed on the dielectric substrate and comprising dual feed lines separate from each other each having a tuning stub;

a patch antenna element disposed on the dielectric substrate and field-coupled to the dual feed lines, said patch antenna element including an active patch antenna element having an outer edge and parasitic patch antenna element supported in spaced relation to the active patch antenna element, wherein said feed lines extend toward the center of the active patch antenna element and the tuning stubs generally orthogonal to each other and each located in close proximity to the outer edge of the active patch antenna element to establish an additional resonant frequency between a resonant frequency of the active patch antenna element and resonant frequency of the parasitic patch antenna element wherein the dual feed lines are configured to provide dual polarization and minimize coupling between the feed lines.

13. A proximity-fed, stacked patch antenna according to claim 12, wherein said patch antenna element is adhesively secured onto the dielectric substrate.

14. A proximity-fed, stacked patch antenna according to claim 12, and further including an insulating spacer layer disposed between and supporting the active patch antenna element from the passive patch antenna element.

15. A proximity-fed, stacked patch antenna according to claim 12, wherein each feed line comprises a microstrip feed line formed on the dielectric substrate.

16. A proximity-fed, stacked patch antenna according to claim 12, wherein said feed lines are positioned substantially orthogonal to each other to provide orthogonal linear polarizations.

17. A proximity-fed, stacked patch antenna according to claim 12, wherein each feed line includes a feed line tip that extends toward the center of the active patch antenna element, wherein said feed line tips are spaced from each other to minimize tip-to-tip coupling.

18. A proximity-fed, stacked patch antenna according to claim 17, wherein each feed line tip includes a ninety degree bend.

19. A proximity-fed, stacked patch antenna according to claim 12, wherein each tuning stub has a length of about one-half a radius of the active patch antenna element.

20. A proximity-fed, stacked patch antenna according to claim 12, wherein each tuning stub is located adjacent to an outer edge formed by the active patch antenna element.

21. A proximity-fed, stacked patch antenna according to claim 12, wherein said active and parasitic patch antenna elements are formed of a metallic material.

22. A proximity-fed, stacked patch antenna according to claim 21, wherein said parasitic patch antenna element comprises a foil disc.

23. A proximity-fed, stacked patch antenna according to claim 21, wherein said active and parasitic patch antenna elements comprise circular discs, said parasitic patch antenna element having a diameter greater than the diameter of said active patch antenna element.

24. A proximity-fed, stacked patch antenna according to claim 12, wherein said active patch antenna element has a first resonant frequency and said parasitic antenna element has a second resonant frequency.

25. A method of forming a proximity-fed, stacked patch antenna comprising the step of:

positioning a patch antenna element formed of an active and parasitic patch antenna element over a dielectric substrate having a conductive feed layer of dual feed lines spaced separate from each other such that the active patch antenna element is field-coupled to the dual feed lines and configured to provide dual polarization and minimal coupling between the feed lines, wherein each active patch antenna element includes an outer edge and each feed line extends toward the center of the patch antenna element, and each feed line includes a tuning stub generally orthogonal to each other and located in close proximity to the outer edge of the active patch antenna element to establish an additional resonant frequency between a resonant frequency of the active patch antenna element and resonant frequency of the parasitic patch antenna element.

26. A method according to claim 25, and further comprising the step of adhesively adhering the patch antenna element to the dielectric substrate.

* * * * *